United States Patent [19]

Stern et al.

[11] Patent Number: 4,568,897

[45] Date of Patent: Feb. 4, 1986

[54] MILLIMETER-WAVE CUT-OFF SWITCH

[75] Inventors: Richard A. Stern, Allenwood; Elio A. Mariani, Hamilton Square, both of N.J.

[73] Assignee: The United States of America as represented by the Secretary of the Army, Washington, D.C.

[21] Appl. No.: 505,666

[22] Filed: Jun. 20, 1983

[51] Int. Cl.[4] ..... H01P 1/15

[52] U.S. Cl. ..... 333/258; 333/262; 357/15

[58] Field of Search ..... 333/250, 258, 262, 248; 357/15, 22

[56] References Cited

U.S. PATENT DOCUMENTS 4,245,230 1/1981 Kwok et al. ..... 333/262 X

OTHER PUBLICATIONS

Fleming, P. L. et al., "GaAs SAMP Device for Ka--Band Switching", *Conf.*, 1979 *IEEE MIT-s Int'l Microwave Symposium Digest*, Orlando FL, Apr. 30–May 2, 1979.

*Primary Examiner*—Eugene R. LaRoche
*Assistant Examiner*—Benny T. Lee
*Attorney, Agent, or Firm*—Anthony T. Lane; Jeremiah G. Murray; Paul A. Fattibene

[57] ABSTRACT

A millimeter-wave cut-off switch in a dielectric waveguide having a semi-insulating core and a semi-conducting epitaxial layer. A controller affixed to the epitaxial layer is alternately switched to vary the conductivity of the epitaxial layer thereby influencing wave propagation in the waveguide. When the waveguide is properly dimensioned such that the operating frequency lies in the high-loss section near the cut-off frequency on the loss vs. frequency characteristic curve, an applied reverse bias voltage produces a switching function in the loss characteristics associated with the wave propagating in the guide thereby resulting in low-loss propagation.

8 Claims, 6 Drawing Figures

MILLIMETER-WAVE CUT-OFF SWITCH

STATEMENT OF GOVERNMENT INTEREST

The invention described herein may be manufactured, used and licensed by or for the Government for Governmental purposes without the payment to us of any royalties thereon or therefor.

CROSS REFERENCE TO RELATED APPLICATIONS

This application is related to the following co-pending applications filed in the names of R. A. Stern and E. A. Mariani, the present inventors:

U.S. Ser. No. 505,668, entitled "Millimeter-Wave Electronic Phase Shifter Using Schottky Barrier Control", filed on June 20, 1983, and U.S. Ser. No. 505,667, entitled "Monolithic Millimeter-Wave Electronic Scan Antenna Using Schottky Barrier Control and Method For Making Same", filed on June 20, 1983.

BACKGROUND OF THE INVENTION

This invention relates generally to millimeter wave control devices and, more particularly, to a monolithic, millimeter-wave cut-off switch.

In millimeter radar systems, cut-off switches are often used as protection devices in order to isolate sensitive receiver components during transmission cycles. The design of such cut-off switches should preferably take full advantage of the established microelectronic art, and should be as simple in structure as possible in order to provide an affordable millimeter wave control device.

While the previous art in millimeter-wave switches is rather limited, the common design for existing devices uses discrete elements such as diodes, ferrite toroids or junctions in various metal waveguide configurations.

One such design is described by R. A. Stern in an article entitled "A Fast 3-mm Ferrite Switch," IEEE Transactions on Microwave Theory and Techniques, September, 1971. This particular device calls for a terrahedral waveguide junction type of switch employing a permanent magnet to which a current pulse is applied in order to effect switching between the transmission state and the reflective state.

The typical problems associated with many of these earlier devices arise from the use of the discrete switching elements which increases both the cost and complexity of the switch.

SUMMARY OF THE INVENTION

The object of the invention is to provide a monolithic switching device for use in a dielectric waveguide configuration.

A further object of the invention is to provide a switch of minimum complexity in order to permit low-cost batch fabrication.

The millimeter-wave cut-off switch according to the invention comprises a waveguide section having a semi-insulating dielectric core and a semi-conducting dielectric epitaxial layer. A Schottky barrier control element deposited on the epitaxial layer provides for the application of a bias voltage to vary the conductivity of the epitaxial layer thereby causing the waveguide to shift from a high-loss mode to a low-loss mode of wave propagation. When the waveguide is designed such that the operating frequency lies relatively close to the cut-off frequency on the loss vs. frequency characteristic curve, this shifting of modes results in on-off switching of the device.

This and other objects and advantages of the invention will become apparent from the following detailed description and drawings.

DETAILED DESCRIPTION OF THE PREFERRED EMBODIMENT

Dielectric waveguides are often used in the millimeter frequency range for electromagnetic wave propagation with substantially negligible power attenuation. Low-loss propagation may be achieved by determining the dimensions of the waveguide in accordance with the desired frequency range of operation such that the transverse dimension of the guide is greater than approximately one-half wavelength in the semiconductor material.

Figure 1:
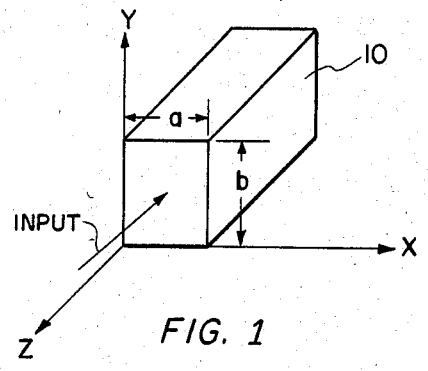
FIG. 1 shows a semiconductor waveguide adapted to propagate millimeter-wave energy.
Figure 2:
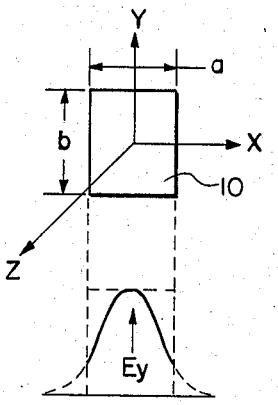
FIG. 2 illustrates an end view of a the waveguide medium of FIG. 1 along with the field configuration for wave propagation.

As shown in FIG. 1, a typical waveguide 10 having a rectangular cross-section of width a and height b propagates low-loss, fundamental-mode wave energy in the Z-axis direction. The waveguide 10 is generally made of a low-loss dielectric material having a relative dielectric constant, $\epsilon_r$, ranging from 2 to 16. In FIG. 2, the end view cross-section of the guide 10 illustrating the distribution of the E-field in the Y-direction, the wave energy is confined to the waveguide except for the exponentially decaying evanescent E-field extension on either side. The distribution is symmetrical in this case since the boundary conditions on the two sides of the waveguide are identical. By altering the boundary conditions of the waveguide, however, it is possible to influence the propagation of the wave energy and to thereby utilize the resulting attenuation characteristic as a switch.

Figure 3:
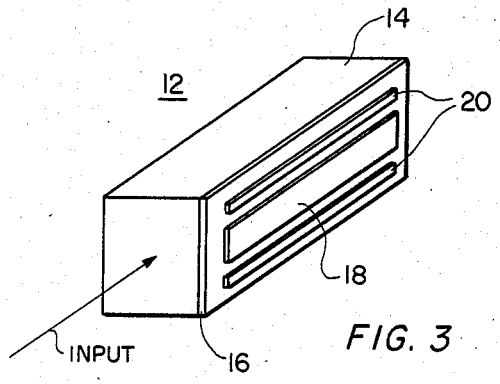
FIG. 3 is a pictorial representation of a millimeter-wave cut-off switch according to the invention.

Referring now to FIG. 3, there is shown a millimeter-wave cut-off switch 12 formed in a section of dielectric waveguide having a semi-insulating core 14 and a semi-conducting epitaxial layer 16, both preferably of gallium arsenide. The thickness of the epitaxial layer 16 is on the order of two to three skin depths for the particular design operating frequency. The terms semi-insulating and semi-conducting are used herein in the relative sense such that the semi-conducting material has a greater number of available conducting electrons than the semi-insulating material. This may be achieved in GaAs, for example, by providing an excess of arsenic (As) in the semi-conducting material. A Schottky barrier electrode 18, which is typically a metallization layer on the order of 1000 Å, and ohmic contacts 20 are provided on the outer surface of epitaxial layer 16 as a means for varying the conductivity of the epitaxial layer 16 to thereby alter the wave propagation characteristic of the device. While the preferred embodiment of the invention uses a dielectric medium of semi-insulating GaAs having a relative dielectric constant, $\epsilon_r$ of approximately 13, alternate embodiments of the device could use other semiconductor materials such as silicon.

Figure 4:
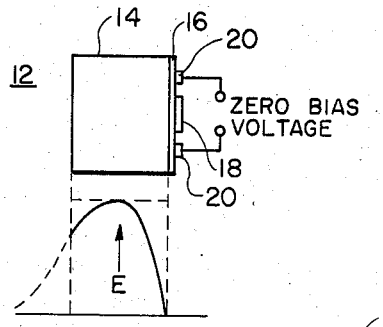
FIG. 4 illustrates an end view of a the device of FIG. 3 and the field configuration for wave propagation with zero bias voltage applied.

The operation of switch 12 relies on a change in the boundary conditions resulting from a change in the depletion depth within epitaxial layer 16. In FIG. 4 is shown an end view of the device of FIG. 3 with zero-bias voltage applied and having an epitaxial layer 16 of thickness on the order of two to three skin depths; the epitaxial layer 14 becomes conductive thereby causing the dielectric waveguide 10 to cut-off low-loss wave propagation at the operating frequency. A physically operating equivalent of this type of control device could be demonstrated by placing a metal barrier adjacent to a dielectric waveguide to thereby create a boundary condition for the conductive or cut-off, state, and by removing the barrier for the propagating state.

Figure 5:
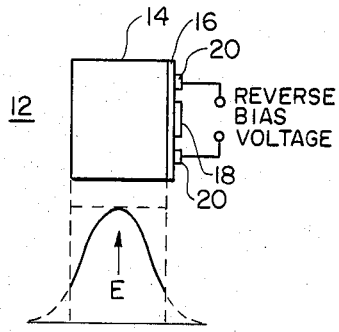
FIG. 5 illustrates an end view of the device of FIG. 3 and the field configuration for wave propagation with a reverse bias voltage applied.

FIG. 5 shows the same view as FIG. 4 but with a reverse bias voltage applied across ohmic contacts 20. This reverse bias alters the boundary condition in the epitaxial layer 16 and reduces the effective thickness of the layer such that it appears to be less than one skin depth and, thus, non-conductive. For the case in which a negative bias of −10 to −20 volts is applied, low-loss wave propagation occurs in waveguide 10 similar to the propagation characteristics of an ordinary waveguide as shown in FIG. 2.

Figure 6:
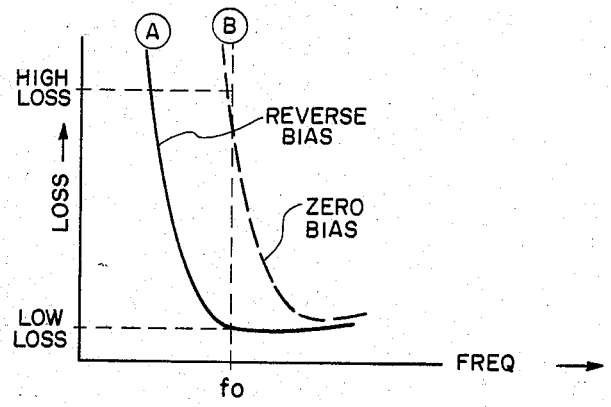
FIG. 6 shows the loss vs. frequency characteristic for the zero bias and reverse bias cases of FIGS. 4 and 5, respectively.

In order for the cut-off phenomenon to occur, the design frequency of operation at negative bias must lie relatively close to the cut-off frequency as determined by the cross-sectional dimensions of the dielectric waveguide. As indicated in FIG. 6 showing the loss vs. frequency characteristic for a design operating frequency of $f_o$, the switching of the bias voltage from a given reverse bias, value to zero bias brings about a switching action in the waveguide from a low-loss mode to a high-loss mode of operation shown as curves A and B, respectively.

In terms of actual construction of the invention, gallium arsenide was selected as the waveguide medium because its high mobility permits faster switching with lower bias voltages compared to other available materials such as silicon and it is compatible with low-cost batch fabrication techniques currently in use in the field of microelectronics.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. A millimeter-wave cut-off switch comprising, in combination:

a semi-insulating longitudinal dielectric waveguide of rectangular cross-section for propagating an energy wave longitudinally along said waveguide; said energy wave having an E-field distribution at a frequency near the high-loss low-loss cut-off frequency associated with said dielectric waveguide;

a semi-conducting epitaxial layer formed on one side surface of said dielectric waveguide; and means for controlling the conductance of said epitaxial layer including a Shottky barrier electrode and ohmic contacts, and having a bias voltage applied across the ohmic contacts so as to change the conductance of said waveguide, resulting in a change in the waveguide propagation characteristic thereby creating a change in the high-loss low-loss cut-off frequency associated with said dielectric waveguide, resulting in the E-field distribution of said energy wave to be displaced within said waveguide which causes substantial attenuation of said energy wave.

2. A cut-off switch as set forth in claim 1 wherein said means for controlling the conductance of said epitaxial layer includes:

a pair of ohmic contacts deposited on said epitaxial layer;

a Schottky barrier electrode deposited on said epitaxial layer between said pair of ohmic contacts; and means for applying a reverse bias voltage to said pair of ohmic contacts whereby the application of said voltage causes a reduction in depletion depth of said epitaxial layer.

3. A cut-off switch as set forth in claim 2 wherein said semi-insulating dielectric waveguide and said semi-conducting epitaxial layer are formed of GaAs.

4. A cut-off switch as in claim 2 wherein said semi-insulating dielectric waveguide and said semi-conducting epitaxial layer are formed of Si.

5. A method of making a millimeter wave cut-off switch comprising the steps of:

forming a longitudinal semi-insulating dielectric waveguide having a rectangular cross-section capable of propagating an energy wave and an energy wave propagation characteristic comprising a high-loss low-loss cut-off frequency associated with said dielectric waveguide;

affixing a semi-conducting epitaxial layer on one side surface of said dielectric waveguide; and providing means for controlling the conductivity of said epitaxial layer including a Schottky electrode and ohmic contacts, which cause a change in the energy wave propagation characteristic thereby creating a change in the high-loss low-loss cut-off frequency associated with said dielectric waveguide, resulting in the E-field distribution of said energy wave to be displaced within said waveguide, causing substantial attenuation of said energy wave.

6. A method as set forth in claim 5 wherein said providing means for controlling the conductivity of said epitaxial layer includes depositing a pair of ohmic contacts on said epitaxial layer; and depositing a Schottky barrier electrode on said epitaxial layer between said pair of ohmic contacts.

7. A method set forth in claim 6 wherein said semi-insulating dielectric waveguide and said epitaxial layer are formed of GaAs.

8. A method set forth in claim 6 wherein said semi-insulating dielectric waveguide and said epitaxial layer are formed of Si.

* * * * *